US007642510B2

(12) United States Patent
McEwen

(10) Patent No.: US 7,642,510 B2
(45) Date of Patent: Jan. 5, 2010

(54) ION SOURCE FOR A MASS SPECTROMETER

(75) Inventor: Charles Nehemiah McEwen, Newark, DE (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 412 days.

(21) Appl. No.: 11/508,444

(22) Filed: Aug. 22, 2006

(65) Prior Publication Data

US 2008/0048107 A1 Feb. 28, 2008

(51) Int. Cl.
*H01J 49/10* (2006.01)

(52) U.S. Cl. ..... 250/288

(58) Field of Classification Search ..... 250/288, 250/423 R

See application file for complete search history.

(56) References Cited

U.S. PATENT DOCUMENTS

| | | | | |
|---|---|---|---|---|
| 6,534,765 | B1 * | 3/2003 | Robb et al. | 250/288 |
| 6,646,257 | B1 | 11/2003 | Fischer et al. | |
| 6,888,132 | B1 * | 5/2005 | Sheehan et al. | 250/288 |
| 7,315,020 | B2 * | 1/2008 | Park et al. | 250/288 |
| 2006/0255261 | A1 * | 11/2006 | Whitehouse et al. | 250/288 |
| 2008/0296485 | A1 * | 12/2008 | Benter et al. | 250/282 |

OTHER PUBLICATIONS

Ostman et. al., Gas Chromatography-Microchip Atmospheric Pressure Chemical Ionization-Mass Spectrometry, Anal. Chem., 2006, vol. 78:3027-3031.

Revelsky et. al., Electron Ionization and Atmospheric Pressure Photochemical Ionization in Gas Chromatography Mass Spectrometryanalysis of Amino Acids, Eur. J. Mass Spectrom., 2003, vol. 9:497-507.

Horning et. al., Atmospheric Pressure Ionization (API) Mass Spectrometry. Solvent-Mediated Ionization of Samples Introduced in Solution and in a Liquid Chromatograph Effluent Stream, Journal of Chromatographic Science, 1974, vol. 12:725-729.

Engelbach et. al., Analysis of Nitropyrenamines and Methylated Nitropyrenamines Via Gas Chromatography—Negative Ion Atmospheric Pressure Ionization Mass Spectrometry, Journal of High Resolution Chromatography & Chromatography Communications, 1988, vol. 11:661-663.

Horning et. al., New Picogram Detecting System Based on a Mass Spectrometer With an External Ionization Source at Atmospheric Pressure, Analytical Chemistry, 1973, vol. 45, No. 6:936-943.

Dzidic et. al., Comparison of Positive Ions Formed in Nickel-63 and Corona Discharge Ion Sources Using Nitrogen, Argon, Isobutane, Ammonia and Nitric Oxide as Reagents in Atmospheric Pressure Ionization Mass Spectrometry, Analytical Chemistry, 1976, vol. 48, No. 12:1763-1768.

(Continued)

*Primary Examiner*—Kiet T Nguyen

(57) ABSTRACT

An ion source able to ionize both liquid and gaseous effluents from interfaced liquid or gaseous separation techniques. The liquid effluents are ionized by electrospray ionization, photoionization or atmospheric pressure chemical ionization and the gaseous effluents from sources such as a gas chromatograph are ionized by a corona or Townsend electrical discharge or photoionization. The source has the ability to ionize compounds from both liquid and gaseous sources, which facilitates ionization of volatile compounds separated by gas chromatography, low volatility compounds separated by liquid chromatography, as well as highly non-volatile compounds infused by electrospray or separated by liquid chromatography or capillary electrophoresis.

29 Claims, 7 Drawing Sheets

OTHER PUBLICATIONS

Kinouchi et. al., Detection of 2-Aminofluorene at Femtogram Levels Via High Resolution Gas Chromatography Combined With Negative Ion Atmospheric Pressure Ionization Mass Spectrometry, Journal of High Resolution Chromatography & Chromatography Communications., 1990, vol. 13:281-284.
Siegel et. al., Ions and Electrons in the Electron Capture Detector, Journal of Chromatography, 1976, vol. 122:397-413.
Mitchum et. al., Capillary Gas Chromatography/Atmospheric Pressure Negative Chemical Ionization Mass Spectrometry of the 22 Isomeric Tetrachlorodibenzo-P-Dioxins, Anal. Chem., 1982, vol. 54:719-722.
Horning et. al., Development and Use of Analytical Systems Based on Mass Spectrometry, Cliinical Chemistry, 1977, vol. 23, No. 1:13-21.
Carroll et. al., Atmospheric Pressure Ionization Mass Spectrometry: Corona Discharge Ion Source for Use in Liquid Chromatograph-Mass-Spectrometer-Computer Analytical System, Analytical Chemistry, 1975, vol. 47, No. 14:2369-2373.
Ketkar et. al., Real-Time Detection of Parts per Trillon Levels of Chemical Warfare Agents in Ambient Air Using Atmospheric Pressure Ionization Tandem Quadrupole Mass Spectrometry, Anal. Chem., 1991, vol. 63:457-459.
Lane et. al., Real-Time Tracking of Industrial Emissions Through Populated Areas Using a Mobile APCI Mass Spectrometer System, Adv. Mass Spectrom., 1980, pp. 1480-1489.
Reid et. al., TAGA 3000: a New, Multipurpose, Digitally Controlled Atmospheric Pressure Chemical Ionization Mass Spectrometer Based System, Adv. Mass Spectrom., 1980, pp. 1843-1850.
Charles et. al., Direct Analysis of Semivolatile Organic Compounds in Air by Atmospheric Pressure Chemical Ionization Mass Spectrometry, Anal. Chem., 2001, vol. 73:5061-5065.
Zehentbauer et. al., Use of Humidified Air in Optimizing APCI-MS Response in Breath Analysis, J. Agric. Food Chem., 2000, vol. 48:5389-5395.
Snyder et. al., Curie-Point Pyrolysis Atmospheric Pressure Chemical Ionization Mass Spectrometry: Preliminary Performance Data for Three Biopolymers, Anal. Chem., 1987, vol. 59:1945-1951.
Steiner et. al., Secondary Ionization of Chemical Warfare Agent Simulants: Atmospheric Pressure Ion Mobility Time-of-Flight Mass Spectrometry, Anal. Chem., 2003, vol. 75:6068-6076.

* cited by examiner

ION SOURCE FOR A MASS SPECTROMETER

CROSS-REFERENCE TO RELATED APPLICATIONS

This application claims priority under 35 U.S.C. §119 from International Application Number PCT/US05/40632, filed Nov. 9, 2005 U.S. Provisional Application Ser. No. 60/687,497, filed Jun. 3, 2005 and claims priority from U.S. Provisional Application Ser. No. 60/626,161, filed Nov. 9, 2004.

FIELD OF THE INVENTION

This invention relates to an atmospheric pressure ionization source that facilitates ionization of either a liquid or gas effluent from different sources, such as a liquid chromatograph or a gas chromatograph, to permit subsequent mass separation of the ions by a mass spectrometer. This invention also relates to a method, using the ionization source, of increasing the number of classes of chemical compounds that can be ionized in the effluent of a gas chromatograph by introduction of a flow of dry clean purge gas, thus minimizing low energy ionization events by reducing water and other impurities in the ionization region. This invention also relates to a method, using the ionization source, of enhancing analysis of a selected class of chemical compounds by introducing a reactive gas into the ionization region of the ionization source so that only compounds of interest are ionized.

As used in this invention a gas chromatograph source may be either a commercially available instrument or a mini-gas chromatograph that is built into a probe assembly that forms a component of the instant ionization source. The probe assembly incorporating the mini-gas chromatograph can replace the interface probe assembly used in liquid chromatography/mass spectrometry (LC/MS). Employing the ionization source of the present invention, a single atmospheric pressure ionization mass spectrometer of any type is made capable of ionizing the effluent from either a liquid chromatograph or a gas chromatograph and of analyzing this effluent.

BACKGROUND

As used herein, the term GC/MS refers to a gas chromatograph (GC) interfaced to a mass spectrometer (MS). The term LC/MS refers to a liquid chromatograph (LC) interfaced to a mass spectrometer. The current practice in mass spectrometry is to have separate instruments for GC/MS and LC/MS operation. At least one manufacturer, Varian, Inc., manufactures a mass spectrometer that can be converted from atmospheric pressure LC/MS to a vacuum ionization GC/MS by breaking vacuum and interchanging ion sources. This approach suffers the disadvantages of being time consuming, requires breaking vacuum and is only applicable on the specific Varian instrument.

Atmospheric pressure ionization mass spectrometers (APIMS) instruments currently available lack flexibility. They are either configured to receive effluent from an up-stream gas chromatograph or from an up-stream liquid chromatograph, but cannot be easily changed to accept an alternate source of effluent. Typically, primary ions are formed at atmospheric pressure by initiation of a gaseous electrical discharge by an electric field or by electrospray ionization (ESI) as described in U.S. Pat. No. 6,297,499 (Fenn) and; U.S. Pat. No. 5,788,166 (Valaskovic). The primary ions in turn ionize the gas phase analyte molecules by either an ion-molecule process as occurs in atmospheric pressure chemical ionization (APCI), by a charge transfer process, or by entraining the analyte molecules in a charged droplet of solvent produced in the electrospray process. In the case of analyte being entrained in a charged liquid droplet, the ionization process is the same as in electrospray ionization (ESI) because the analyte molecules are first entrained in the liquid droplets and subsequently ionized.

Electrospray ionization (ESI) is a powerful method for producing gas phase ions from compounds in solution. In ESI, a liquid is typically forced from a small diameter tube at atmospheric pressure. A spray of fine droplets is generated when a potential of several thousand volts is applied between the liquid emerging from the tube and a nearby electrode. Charges on the liquid surface cause instability so that droplets break from jets extending from the emerging liquid surface. Evaporation of the droplets, typically using a counter-current gas, leads to a state where the surface charge again becomes sufficiently high (near the Raleigh limit) to cause instability and further smaller droplets are formed. This process proceeds until free ions are generated by either the evaporation process described above or by field emission that occurs when the field strength in the small droplets is sufficiently high for field evaporation of ions to occur. Molecules more basic than the solvent being used in the ESI process are preferentially ionized. Because ESI generates gas phase ions from a liquid, it is an ideal ionization method for interfacing liquid chromatography (LC) to mass spectrometry (MS). The power of ESI for the analysis of compounds as large and diverse as proteins won the 2003 Nobel prize in Chemistry for John Fenn. The combination of ESI with MS with liquid separation methods is extremely powerful analytically and results in large numbers of LC/MS instruments being sold each year.

Because ESI is most sensitive and most suitable for basic and polar compounds, most LC/MS instrumentation incorporates an alternative atmospheric pressure ionization (API) technique called atmospheric pressure chemical ionization (APCI). APCI was initially developed by Horning, et al. using $^{63}$Ni beta decay for ionization. See Horning, E. C.; Horning, M. G.; Carroll, D. I.; Dzidic, I.; Stillwell, R. N., *New Picogram Detection System Based on a Mass Spectrometer with an External Ionization Source at Atmospheric Pressure*. Anal. Chem., 1973. 45: p. 936-943. A discharge ion source has since replaced the $^{63}$Ni as the source of ionization. A discharge is generated when a voltage, typically applied to a metal needle, is increased to a range where electrical breakdown (formation of free electrons and ions) of the surrounding gas occurs (typically several thousand volts). The primary use of this ionization method has been as an ionization interface between liquid chromatography and mass spectrometry. See Dzidic, I.; Carroll, D. I.; Stillwell, R. N.; Horning, E. C., *Comparison of Positive Ions formed in Nickel-63 and Corona Discharge Ion Sources using Nitrogen, Argon, Isobutene, Ammonia and Nitric Oxide as Reagents in Atmospheric Pressure Ionization Mass Spectrometry*. Anal. Chem., 1976. 48: p. 1763-1768. This ionization method relies on evaporation of the liquid exiting the liquid chromatograph with subsequent gas phase ionization in a corona discharge. The primary ions produced in the corona discharge are from the most abundant species, typically nitrogen and oxygen from air or solvent molecules. Regardless of the initial population of ions produced in the corona discharge, diffusion controlled ion-molecule reactions will result in a large steady state population of protonated solvent ions. These ions in turn will ionize analyte molecules by proton transfer if the reaction is exothermic or by ion addition if the ion-molecule product is stable and infrequently by charge transfer reactions. While this technique tends to be more sensitive than ESI for low molecular weight and less polar compounds, it nevertheless is not sensitive for highly volatile compounds and those less basic than the LC solvent. Thus, neither atmospheric pressure chemical ionization (APCI) nor electrospray ionization (ESI) are good ionization methods for a large class of volatile and less polar compounds. For this reason, other ionization methods, such as photoionization have been applied to LC/MS to more effectively reach a subset of this class of compounds (See, for example U.S. Pat. No. 5,245,192, U.S. Pat. No. 6,646,256, U.S. Pat. No. 6,630,664, and published U.S. application US20030111598). Photoionization at atmospheric pressure uses an ultraviolet (UV) source for ionization of gas phase molecules. Typically, a plasma-induced discharge lamp that produces ultraviolet radiation in the range of 100-355 nanometers (nm) is used to generate ionization. Such a source, suitable for use with LC/MS, is available from Synagen Corporation, Tustin, Calif.

Thus, liquid chromatographs interfaced with the atmospheric pressure ionization methods of ESI and APCI are in common use and frequently the mass spectrometers associated with these ionization methods have advanced analytical capabilities such as $MS^n$ (MS/MS, MS/MS/MS, etc.) and/or high mass resolution and accurate mass analysis. However, LC/MS instruments do not effectively address a large class of important volatile and less polar compounds. Herein is described atmospheric pressure ionization for gas chromatographic effluents which is capable of ionizing a large portion of this compound class with high chromatographic resolution and high sensitivity using mass spectrometers designed for LC/MS applications.

Gas chromatography is commonly interfaced to mass spectrometers. The gas chromatograph is limited to volatile molecules but has higher resolving power than liquid chromatography based instruments. The gas chromatograph operates at atmospheric pressure and is interfaced to the mass spectrometry through a pressure drop device. Commonly, the pressure drop device is capillary tubing or a so-called 'jet separator', both of which limit the volume of gas entering the vacuum region of the mass spectrometer.

Gas chromatographs have been interfaced to API sources. A series of publications have appeared where the effluent from a gas chromatograph is ionized at atmospheric pressure using radioactive $^{63}$Ni as the source for production of negative ions. The most recent publication is Kinouchi, T.; Miranda, A. T. L.; Rushing, L. G.; Beland, F. A.; Korfmacher, W. A., J. High Resolution Chromatogr. & Chromatogr. Commun., 1990. 13(1): p. 281-284. The interface used in these experiments couple the GC to a $^{63}$Ni ion source of a specially built mass spectrometer, such as from Extranuclear Laboratories, Inc. (now ABB, Inc.) (See Siegal, M. W.; McKeown, M. C., J. Chromatogr., 1976. 122: p. 397) or a Finnigan-MAT 4000 (now Thermo Finnigan) (See Mitchum, R. K.; Korfmacher, W. A.; Freeman, J. P., *An Atmospheric Pressure Ionization Source for a Finnigan-MAT* 4000 *Mass Spectrometer*. Anal. Instrumentation, 1986. 15(1): p. 37-50). The publications, however, do not disclose any of the essential parameters that would allow transfer of the technology to modern atmospheric pressure instruments that have been designed for LC/MS applications. In addition, only negative ionization is discussed in the publications, a method limited to highly electronegative compounds.

A review paper by E. C. Horning, et al discusses both GC/APIMS and LC/APIMS ion sources (See Horning, E. C.; Carroll, D. I.; Dzidic, I.; Haegele, K. D.; Lin, S.-N.; Oertil, C. U.; Stillwell, R. N., *Development and Use of Analytical Systems Based on Mass Spectrometry*. Clin. Chem., 1977. 23(1): p. 13-21). This article shows diagrams of each ion source and refers back to two previous publications for details on LC/APIMS and on GC/APIMS. (Respectively see Carroll, D. I.; Dzidic, I.; Stillwell, R. N.; Haegele, K. D.; Horning, E. C., *Atmospheric Pressure Ionization Mass Spectrometry: Corona discharge Ion Source for use in a Liquid Chromatography-Mass Spectrometry-Computer Analytical System*. Anal. Chem., 1975. 47: p. 2369-2373 and see Dzidic, I.; Carroll, D. I.; Stillwell, R. N.; Horning, E. C., *Comparison of Positive Ions formed in Nickel-*63 *and Corona Discharge Ion Sources using Nitrogen, Argon, Isobutene, Ammonia and Nitric Oxide as Reagents in Atmospheric Pressure Ionization Mass Spectrometry*. Anal. Chem., 1976. 48: p. 1763-1768.

However, it is believed that there are no reports of an LC/APIMS source and a GC/APIMS source being interfaced to the same mass spectrometer or of a combined LC/APIMS and GC/APIMS source, or of interfacing a gas chromatograph to a mass spectrometer that is designed for LC/APIMS introduction. Nor have there been reports of switching between LC/MS and GC/MS operation in seconds as can be done with the present invention. In particular, the use of a dry purge gas to increase the types of compounds that can be ionized at atmospheric pressure has not been reported. Electrospray ionization has not been discussed in the literature in relation to GC/APIMS nor have the necessary conditions for effectively transporting compounds from the gas chromatograph to the atmospheric ionization region been discussed. No work has been reported on accurate mass measurement of atmospheric pressure GC/MS produced ions, or on GC/APIMS/MS or on GC/APIMS selected or multiple ion monitoring, all of which are techniques that are not readily available in most GC/MS instrumentation.

Commercial mass spectrometers have been manufactured that analyze gaseous compounds using corona discharge APCI, e.g. ABB, Inc., Extrel Quadrupole mass spectrometers, described in Ketkar, S. N.; Penn, S. M.; Fite, W. I., *Real-time Detection of Parts per Trillion of Chemical Warfare Agents in Ambient Air Using Atmospheric Pressure Ionization Tandem Quadrupole Mass Spectrometry*. Anal. Chem., 1991. 63: p. 457-459. and Sciex. mass spectrometers, described in Lave, D. A.; Thompson, A. M.; Loveft, A. M.; Reid, N. M., Adv. Mass Spectrom., 1980. 8B: p. 1480. and Reid, N. M.; Buckley, J. A.; Pom, C. C.; French, J. B., Adv. Mass Spectrom., 1980. 8B: p. 1843. Two patents (EP 0819937 A2 and U.S. Pat. No. 5,869,344) which disclose use of a Venture pump in combination with water vapor introduction for analysis of trace volatiles in air from sources such as breath and fragrances emulating from skin and clothing. Papers by L. Charles, et al and by G. Zehentbauer, et al have been published that reportedly improve on this method. (Respectively see Charles, L.; Riter, L. S.; Cooks, R. G., *Direct Analysis of Semivolatiel Organic Compounds in Air by Atmospheric Pressure Chemical ionization Mass Spectrometry*. J. Agric. Food Chem., 2000. 48: p. 5389-5395. and see Zehentbauer, G.; Kirck, T.; Teineccius, G. A., J. Agric. Food Chem., 2000. 48: p. 5389-5395.)

Pyrolysis with ionization of the gaseous pyrolysate has been reported, (see Snyder, A. P.; Kremer, J. H.; Mouzelaar, H. L. C.; Windig, W.; Taghizahed, K., *Curie-point pyrolysis atmospheric pressure chemical ionization mass spectrometry: preliminary performance data for three biopolymers*. Anal. Chem., 1987. 59: p. 1945-1951. while W. E. Steiner, et al has reported APCI of warfare agent simulants (see Steiner, W. E.; Clowers, B. H.; Haigh, P. E.; Hill, H. H., *Secondary Ionization of Chemical Warfare Agent Simulants: Atmospheric Pressure Ion Mobility Time-of-Flight Mass Spectrometry*. Anal. Chem., 2003. 75: p. 6068-6076.

A wafer thermal desorption system has been described for introducing samples into APIMS (in published US patent application US2002148974). Several patents (for example, JP2002228636, WO2002060565, U.S. Pat. No. 6,474,136, US2003092193, US2003086826, U.S. Pat. No. 6,032,513, U.S. Pat. No. 6,418,781, JP09015207, and JP06034616) discuss the use of GC and APIMS for the analysis and quantitation of trace gases such as hydrogen, oxygen, argon, carbon dioxide, carbon monoxide, freons, silanes, and other compounds that are gases at ambient temperature, primarily for the semiconductor industry.

Currently available mass spectrometers do not combine LC/MS and GC/MS in a single instrument without major source modification. The great majority of mass spectrometers are either designed for LC/MS operation or GC/MS operation, but not both. Many laboratories will have both GC/MS and LC/MS instruments available, but a growing number of laboratories have only LC/MS instrumentation. Therefore, it is desirable to devise an ionization source that allows commonly available LC/MS mass spectrometers to be interfaced to gas chromatographs. Such an instrument would extend the coverage of compounds that can be analyzed by currently available LC/MS instruments. Such an interface would have the additional advantage that the advanced capabilities common in LC/MS instruments, but not common in GC/MS instruments (e.g. techniques known to those practiced in the art such as cone-voltage fragmentation, $MS^n$, high-mass resolution, accurate mass measurement) would become available to GC/MS analysis without purchase of new and expensive instrumentation. A gas chromatograph built into a probe that can be inserted into the standard LC/MS probe inlet would allow rapid switching between LC and GC/MS operation with little modification of the LC/APIMS ion source.

SUMMARY OF INVENTION

An ionization source useful with an atmospheric pressure mass spectrometer, the source capable of ionizing either liquid or gaseous effluent from a preceding separation apparatus, such as a gas chromatograph or a liquid chromatograph, and capable of introducing the ions from the atmospheric pressure region into the vacuum region of the mass spectrometer for mass analysis of the ions, the source comprising: an ionization arrangement for generating an electric discharge, such ionization arrangement being connected to a high voltage source, or a photoionization arrangement employing an ultraviolet (UV) lamp for producing ions by photoionization; and an enclosure for enclosing the ionization arrangement thereby defining an ionization region, the enclosure having at least one port for introducing an effluent, from either a source of liquid effluent or a source of gaseous effluent, and an aperture for introducing ions into the vacuum region of the mass spectrometer.

The enclosure further comprises a port for introducing a purge gas or a reactive gas and a vent for venting excess purge gas from the enclosure. A heater is provided for heating the gas. The at least one port for introducing an effluent may be configured as multiple ports, each port being configured to accept an interface probe from a respective preceding separation apparatus, which supplies a liquid effluent or gaseous effluent.

The ionization arrangement for generating an electric discharge comprises a sharp-edged or pointed electrode onto which a high voltage is applied to generate a Townsend or corona discharge. The ionization arrangement for generating an electric discharge may comprise a solvent-filled capillary or wick structure, whereby an electrospray ionization is generated by application of a high voltage. The photoionization arrangement may comprise a suitable lamp for generating ionizing radiation, such as a plasma induced discharge (PID) lamp.

The present invention also provides a method of increasing the scope of compounds that can be analyzed at atmospheric pressure by the introduction of a dry, clean purge gas, preferably nitrogen, into the ionization region to help exclude air and water. Under conventional APCI conditions there is sufficient water vapor and other organic vapors to cause all of the primary ionization to be in the form of protonated water clusters, protonated solvent, and/or protonated contaminants. The ions formed from water, solvent and/or contaminants in turn undergo exothermic, but not endothermic, proton transfer reactions. Thus, only compounds more basic than the source of the ionization (water, solvent, or contaminants) are ionized. This reaction series can be shown for nitrogen gas containing trace levels of water;

$$N_2+e \rightarrow N_2^+ + 2e$$

$$N_2^+ + 2N_2 \rightarrow N_4^+ + N_2$$

$$N_4^+ + H_2O \rightarrow H_2O^+ + 2N_2$$

$$H_3O^+ + n(H_2O) + N_2 \rightarrow H^+(H_2O)_n + N_2$$

$$H^+(H_2O)_n + A \rightarrow AH^+ + nH_2O \text{ (where A=analyte).}$$

With the addition of dry and clean purge gas, sufficient water and organic contaminants (solvents are not present with GC) can be excluded from the ionization region so that higher energy primary ions (e.g., $N_2^+$, $N_4^+$, $H_3O^+$, etc.) become available for ionization of the GC effluent. Thus, for example, charge transfer reactions between the inert gas and the sample can occur, which increases the scope of compounds that can be ionized. Compounds such as benzene, napthalene, chlorophenol, and other compounds that are not readily ionized under normal APCI conditions can thus be ionized. In addition, compounds that are poorly ionized in liquid APCI or ESI are readily ionized by gas phase APCI using this methodology, thus increasing the sensitivity of analysis. By excluding contaminants, the sensitivity of both APCI and photoionization may be improved since ion current from background contaminants is reduced.

Gas chromatographic columns made of fused silica typically have a polyimide coating, which can be a source of contaminant ions that originate from thermal breakdown of the polyimide coating at typical operating temperatures used in the interface between the GC and the APIMS. Removal of the polyimide coating along a section of the GC column adjacent to the exit end may be performed by either: flame removal; chemical removal by use of liquid acids, bases, or solvents; or by high temperature pre-conditioning of that section of the column for a sufficient time interval. Such removal or pre-conditioning minimizes the observation of contaminant ions in the mass spectrometer and improves the signal to noise.

The present invention also provides a method for adding reactive gases to the dual ion source region to limit the kinds of compounds that can be ionized by GC/APIMS. For example, addition of ammonia gas allows only compounds more basic than ammonia or those that form stable gas phase ion clusters with $NH_4^+$ to be ionized. This can be advantageous when the compounds of interest are highly basic compounds in a matrix of less basic compounds that are not of interest. An example would be ionization of amine containing compounds in, for example, fuel oil without ionization of aromatic hydrocarbons and oxygen containing compounds.

The present invention also provides a method of heating the capillary column to its tip without cool spots. This is necessary with atmospheric pressure GC/MS in order to maintain chromatographic resolution for less volatile compounds. The preferred method involves heating a gas, typically nitrogen, by passing it through tubing that runs through the GC oven into the heated GC to MS transfer line and through a sheath tube that is coaxial with the GC column and extending to or near the exit tip of the GC column. The hot gas passing over the GC column prevents any cool spots even to the very tip of the capillary and in addition may provide a focusing gas stream that guides the analyte toward the MS entrance aperture. Alternatively, resistive heating may be used to heat a thermally conductive sheath that snugly fits over the GC column. The material may be made of any thermally conductive material, such as ceramic or metal to conduct heat from the resistive heater to the GC capillary column. In addition, fused silica GC columns coated with an electrically conductive material, such as metal or carbon, can be resistively heated by passage of an electric current through the conductive coating.

The present invention can use any commercially available GC, GC to mass spectrometer interface, and any commercially available mass spectrometer designed for liquid chromatography using atmospheric pressure ionization. The GC may be a mini GC that is sufficiently small to fit into a hand-held probe that can be inserted into the standard LC ESI/APCI probe inlet adjacent to the ion region. Alternatively a second inlet may be provided, allowing simultaneous insertion of both an LC probe and a GC probe into the ionization region.

The present invention allows GC/MS analysis to incorporate all of the potential of the mass spectrometer, known to those skilled in the art, for selected or multiple ion monitoring, for accurate mass measurement, for cone voltage fragmentation, for $MS^n$ experiments, and the like.

The present invention provides several advantages over the current art in mass spectrometry. By using an atmospheric pressure ion source and interface to the mass spectrometer, in accordance with the invention described herein, any LC/MS instrumentation can be converted to a dual LC/APIMS and GC/APIMS configuration. Using the present invention, the effluent from the GC or from the LC is ionized at atmospheric pressure, thus facilitating rapid switching between the two separation methods.

The dual ion source described herein, when compared to LC/MS stand-alone instrumentation, has higher chromatographic resolution and higher sensitivity for many volatile compounds when they are separated using gas chromatography. By using the method of the present invention, some chemical compound types that cannot be ionized by LC/APIMS can be ionized by GC/APIMS and many other chemical compound types can be ionized with greater sensitivity.

GC/APIMS also has advantages over GC/vacuum MS. Many LC/MS instruments are capable of accurate mass measurement and selected ion fragmentation (i.e., MS/MS) whereas few GC/MS instruments have such capabilities. Conversion of LC/MS instrumentation having such features to the dual ion source of the present invention described herein also provides these features to GC/APIMS operation. The present invention permits higher linear carrier gas velocity and shorter GC columns, which in turn permits higher boiling compounds to be analyzed, since GC/APIMS is not deleteriously affected by high GC carrier gas flow as is GC/vacuum MS.

The present invention is a device that enables interfacing gas chromatographs (GC) to commercially available atmospheric pressure ionization mass spectrometers (APIMS) which are designed to interface to liquid separation methods such a liquid chromatography (LC) or capillary electrophoresis (CE). The present invention provides a mass spectrometry apparatus that provides both GC/APIMS and LC/APIMS operation on the same instrument. The primary ionization process for the gas chromatographic effluent occurs at atmospheric pressure using a Townsend or Corona discharge, using photoionization or optionally using electrospray ionization.

Advantages of GC/APIMS include simple inter-conversion between LC/APIMS and GC/APIMS operation, extended range of compounds that can be analyzed by APIMS by use of a dry purge gas, higher chromatographic resolution than obtainable with LC/MS, and no vacuum limitation of the GC flow rate allowing faster separations and separation of less volatile compounds. In addition, a mini GC built into a probe or flange that inserts into the probe position used for the LC interface is demonstrated to be a facile method for switching between LC/MS and GC/APIMS operation.

The present invention is also useful for the analysis of compounds that have sufficient volatility, or that can be made sufficiently volatile by using derivatization methods known in the art, to pass through a gas chromatograph while excluding saturated hydrocarbon compounds that cannot be ionized under atmospheric pressure conditions. As an example, GC/APIMS is useful for the analysis of environmental pollutants, synthetic products, off-gas products from polymers and other solid or liquid materials, lipids, fatty acids, alcohols, aldehydes, amines, amino acids, contaminants, drugs, metabolites, esters, ethers, halogenated compounds, certain gases, glycols, isocyanates, ketones, nitrites, nitroaromatics, pesticides, phenols, phosphorus compounds, polymer additives, prostaglandins, steroids, and sulfur compounds.

BRIEF DESCRIPTION OF THE DRAWINGS

The invention will be more fully understood from the following detailed description taken in connection with the accompanying drawings, which form a part of this application and in which:

FIG. 5A shows results without a purge gas; FIG. 5B shows results using nitrogen as a purge gas; and FIG. 5C shows the API mass spectrum from a compound in the calibration mixture eluting from the GC.

DETAILED DESCRIPTION OF THE INVENTION

Figure 1:
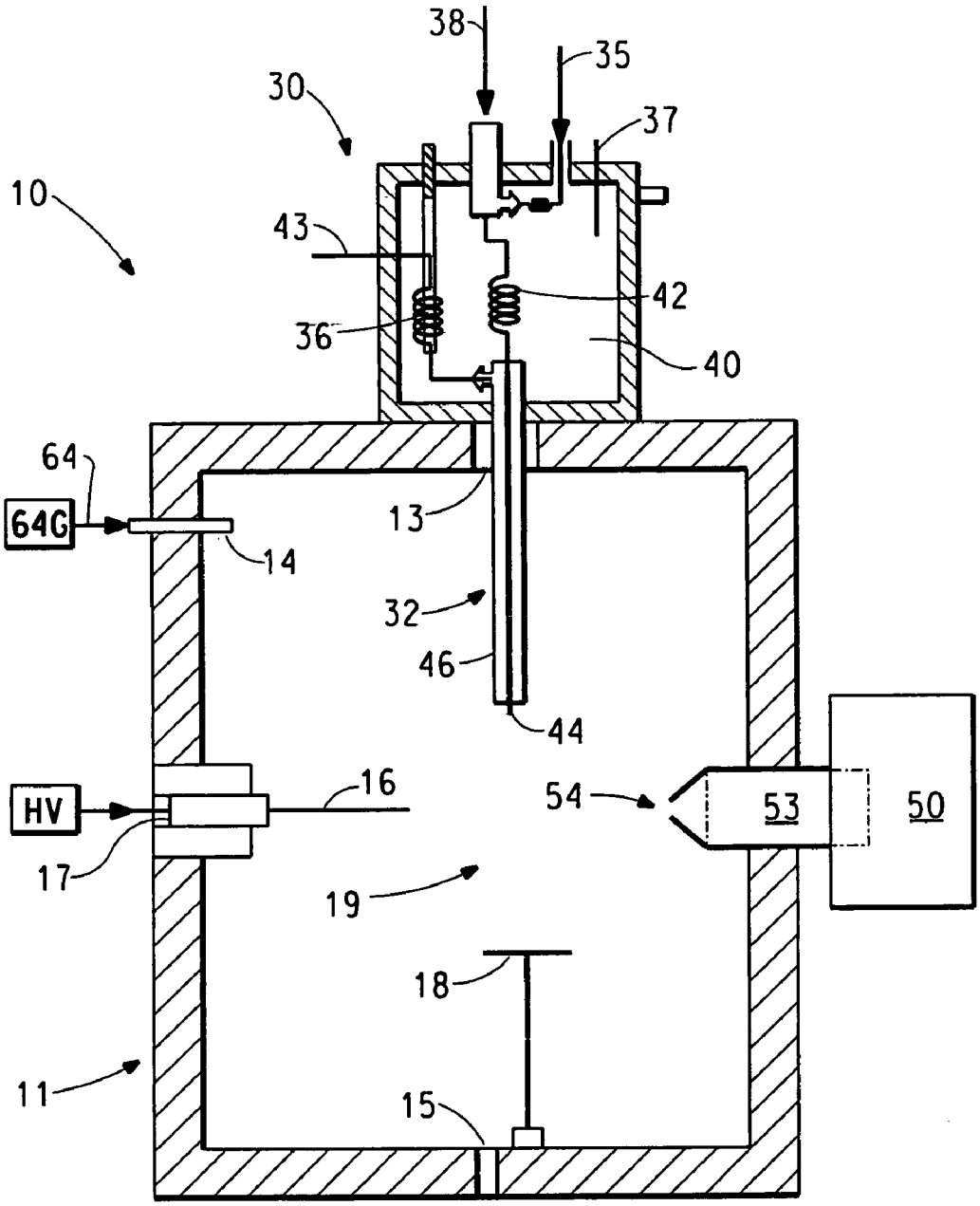
FIG. 1 is a sectional view of an embodiment of an atmospheric pressure ionization (API) source region showing replacement of the liquid chromatograph (LC) interface probe with a probe containing a gas chromatograph (GC) oven and sample injector interfaced with the atmospheric pressure ionization region.

Throughout the following detailed description similar reference numerals refer to similar elements in all figures of the drawings.

Figure 2:
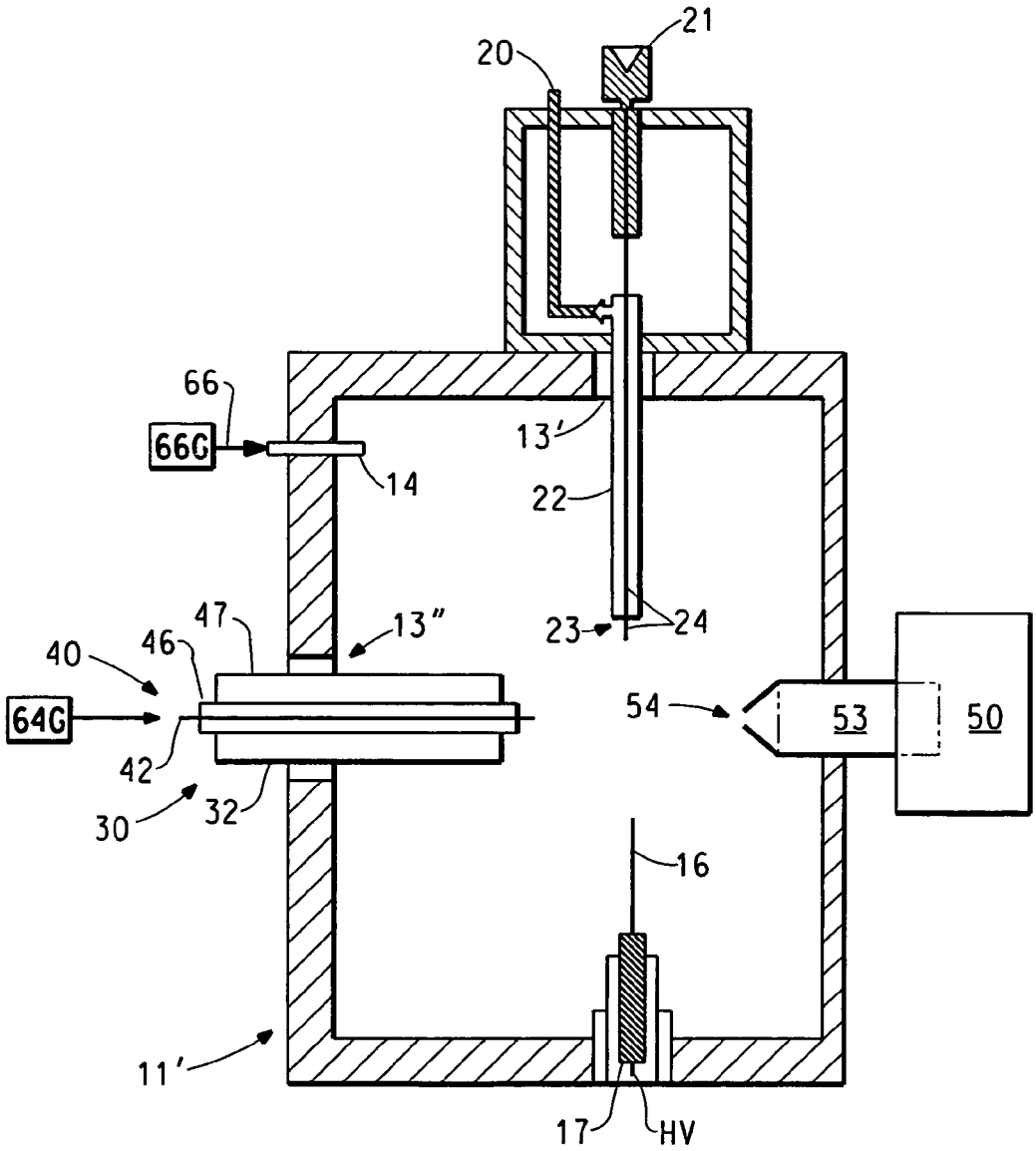
FIG. 2 is a sectional view of a second embodiment of an atmospheric pressure ion (API) source region showing incorporation of both an LC interface probe and a GC interface.
Figure 3:
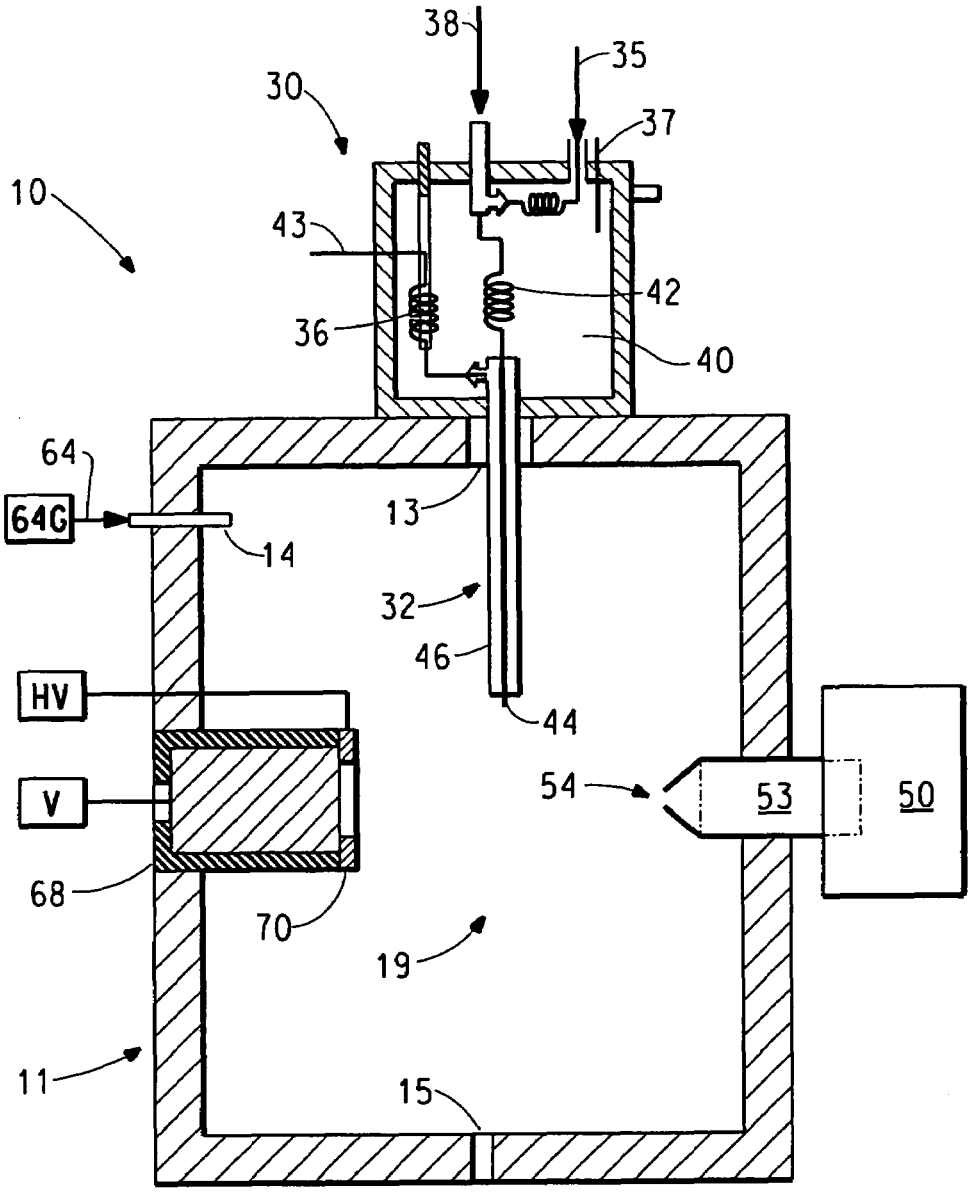
FIG. 3 is a modified embodiment of the API ion source shown in FIG. 1 showing a UV lamp as the source of ionization.
Figure 4:
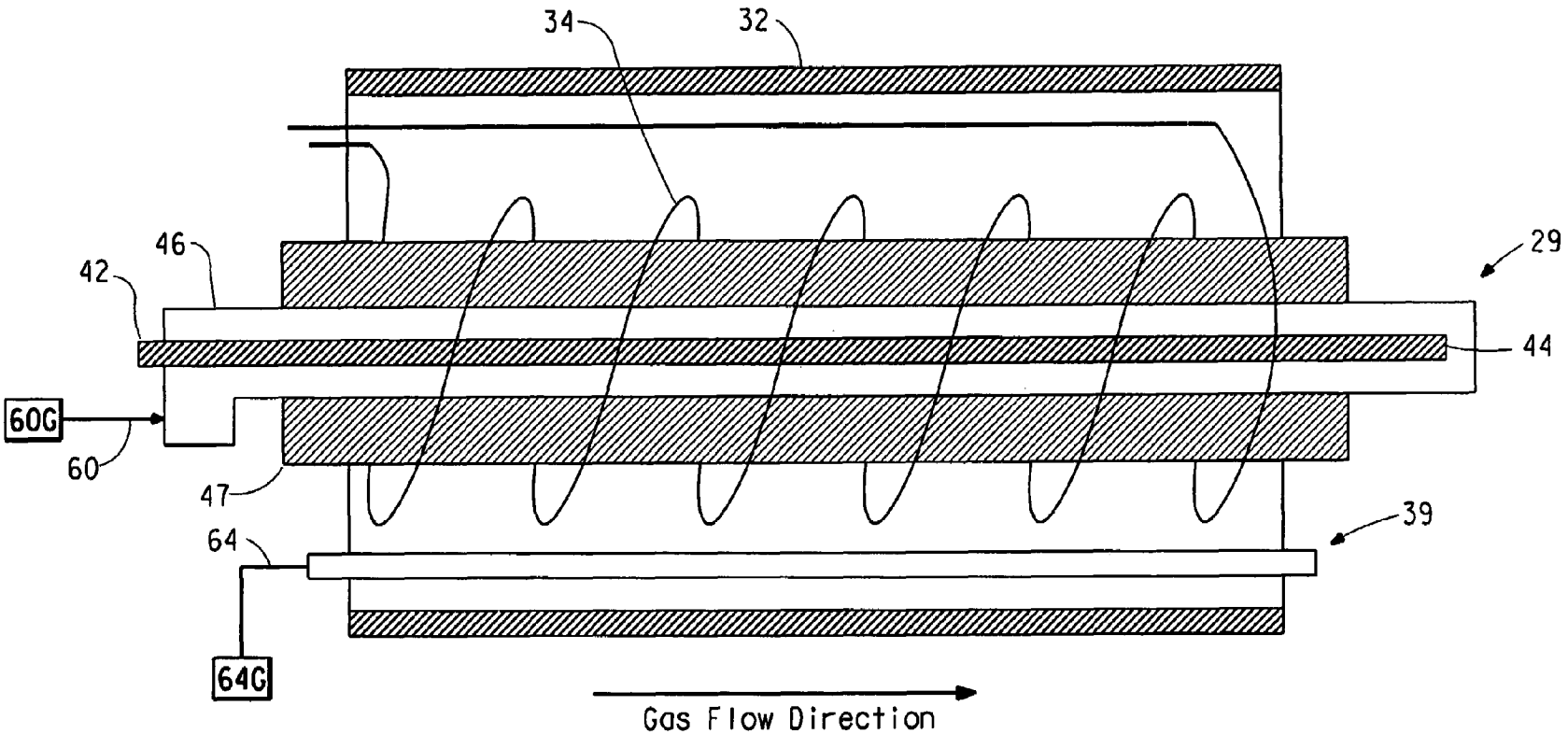
FIG. 4 is a sectional view of the exit tip of the GC interface showing use of an inert gas flow to heat the capillary column to the exit tip.

Alternate embodiments of the present invention of interfacing a gas chromatograph (GC) to an atmospheric pressure liquid chromatograph/mass spectrometer (AP-LC/MS) instrument are shown in FIGS. 1, 2 and 3. FIG. 4 shows a sectional view, in greater detail, of the interface tube of FIG. 1, 2 or 3.

FIG. 1 shows an atmospheric pressure ionization source 10 comprising an enclosure or housing 11, for receiving a gas chromatography probe 30 and for interfacing an associated gas chromatograph oven 40 to an associated mass spectrometer 50. The enclosure 11 has an outlet aperture 54 for introducing ions into a vacuum region 53 of the mass spectrometer 50. The outlet aperture 54 communicates directly and merges into the entrance aperture (also known as a skimmer aperture) of the mass spectrometer 50. FIG. 2 shows an enclosure 11' that has a port 13' for receiving an LC probe 20 and a port 13" for receiving the GC probe 30. Other embodiments using these basic components can be envisioned.

Referring again to FIG. 1 the ionization source 10 comprises at least one port 13 for receiving the GC probe 30. An inlet port 14 and one or more gas vent(s) 15 extend through the wall of the enclosure 11. An electrode 16 supported by an electrically insulating sleeve 17 is mounted on the enclosure 11. The electrode 16 extends through the wall of the enclosure and is connected to a source of high voltage HV (typically from one thousand to ten thousand volts, preferably from two thousand to six thousand volts) A counter electrode 18, shown grounded to the enclosure 11, is used in conjunction with the electrode 16. When the electrode 16 is energized by the high voltage source HV an electric discharge is generated between the electrode 16 and the counter electrode 18. The volume within the enclosure 11 adjacent to the electrode 16 and the counter electrode 18 defines an ionization region 19.

The GC probe 30 includes a heated tubular interface device 32 (FIGS. 1-3) that interfaces the gas chromatograph oven 40 to the mass spectrometer 50. The GC oven 40 has a heater element 36, a thermocouple 37. and an injector 38. A helium carrier gas, illustrated by the flow arrow 35, supplies the GC column 42. The length of the tubular interface 32 may vary from as short as about one centimeter for micro-GC's to as long as about one meter for conventional GC's. This tubular interface 32 can be fabricated from a commercially available GC/MS interface in which the temperature inside the tubular device is maintained high by resistive heating. A downstream portion of the coiled capillary GC column 42 extends through the heated tubular interface 32 in a coaxial manner. The capillary GC column 42 has an exit tip 44 at its exit end within the enclosure 11. The capillary GC column 42 may have an electrically conductive-coating (not shown).

An inert gas entrance port 43 allows the gas to flow through a metal or fused silica tube heated by a heat source 36 before passing through a sheath tube 46 and over the downstream portion of the capillary GC column 42. The interface tube 32 from the GC can be adjusted in position to be as close as one millimeter or as far as twenty-five millimeters from the aperture 54 of the mass spectrometer 50. The electrode 16 is typically located within five centimeters of the aperture 54. The direction of flow of the GC effluent relative to the flow of gas into the mass spectrometer is between ninety degrees, as shown in FIG. 1, and one-hundred-eighty degrees, as shown in FIG. 2.

The GC column 42 is heated along its length from the injector 38, through the GC oven 40, all the way to the exit tip 44. The heating prevents cold spots along the capillary GC column 42 which degrade analytical resolution, especially for less volatile components. The heating may be accomplished by either arranging a resistive heater along the tubular interface 32 (as shown in FIG. 4) or by resistively heating the electrically conductive-coated GC column (not shown). Alternatively, referring to FIG. 4, a heated dry clean inert gas (illustrated by the flow arrow 60) may be passed through the sheath tube 46 that surrounds the GC column 42 in a coaxial manner. The heated dry, clean inert gas is supplied from a gas source 60G and flows through the sheath tube 46 to the exit tip 44. The sheath tube 46 may be electrically conductive or non-conductive. The inert gas may be heated by a heat source 62 upstream of sheath tube 46. An optional purge gas (flow arrow 64) from gas source 64G, preferably clean, dry nitrogen, can pass through the interface 32 and exit at end 39. The purge gas is warmed by the heat from the interface heater 34. The interface heater 34 applies heat directly to a heat transfer tube 47 which in turn heats the sheath tube 46 and the inert gas flowing therein.

The exit tip 44 of the GC column (FIG. 4) is positioned near the outlet aperture 54 (FIG. 1). Ionization is initiated using a Townsend or corona gaseous discharge (as seen in FIGS. 1 and 2) or by photoionization (as seen in FIG. 3), or by an ESI probe 22 shown in FIG. 2. The effluent from the GC column 42 is swept out of the ionization region 19 by a flow of a clean dry purge gas illustrated by the flow arrow 64. Nitrogen vapor, typically from a liquid nitrogen supply 64G (FIGS. 2 and 4), may be used as the purge gas. This flow of gas is necessary so that chemical components exiting the GC column 42 are rapidly swept through the ionization region 19 through gas vent 15 to maintain the chromatographic resolution in the mass spectrometer signal.

The ionization region 19 preferably is enclosed such that a dry clean purge gas (flow arrow 64 shown in alternate locations in FIGS. 2, 3 and 4), preferably nitrogen, can be continuously added to the ionization region 19 through the gas inlet 14 (FIG. 3) or through the interface 32 (FIG. 4) to minimize the presence of water vapor and contamination within the ionization region 19. Under these conditions, more chemically diverse compounds may be ionized relative to prior art sources, such as a so-called open APCI source or wet sources of nitrogen gas or in which gaseous contaminants have not been minimized.

This invention produces a more universal ion source than has previously been available to mass spectrometry. A typical LC/MS ion source that has interchangeable ESI and APCI probes can be modified for GC/APIMS operation by replacing either the ESI or the APCI probe with the GC to MS interface probe 30, as shown in FIG. 1 and FIG. 3. Alternatively, a separate introduction device for the GC to mass spectrometry interface can be built into the source so that the GC oven 40 is always interfaced to the mass spectrometer 50 as shown in FIG. 2. It may thus be appreciated that the source is capable of ionizing either liquid or gaseous effluent from a preceding separation apparatus and of introducing the ions from the atmospheric pressure region into the vacuum region of the mass spectrometer for mass analysis of the ions.

The GC can be a micro GC that is built into the ion source region or is part of the probe assembly (FIGS. 1 and 3). The term "probe" refers to a device for introducing compounds into a mass spectrometer ionization region and is well known to those experienced in the practice of mass spectrometry.

Typically, ionization is initiated by an electric discharge and can use the same high voltage electronics and discharge electrode 16, usually in the form of a metal needle, that is available with commercial APCI ion sources designed for interface with a LC. Alternatively, if only an ESI source is available, an electric discharge can be initiated by placing an electrically conductive material such as a needle or a drawn metal-coated capillary in place of the electrospray capillary 23 (FIG. 2). With a sharp tip discharges are generated in the voltage range used by the ESI source. In a typical discharge ionization source, the primary ionization processes involves stripping of electrons from abundant gaseous species for positive ionization, or for negative ionization electron resonant or dissociative electron attachment to the most electronegative gaseous components. The electron stripping process produces positive ions that undergo further reactions during collisions and result in charge transfer where thermodynamically favored. For water vapor, hydronium ions are produced which undergo further collisions resulting in production of protonated water clusters, (i.e. $[(H_2O)_x]H^+$). Because these gas phase reactions are diffusion controlled and at atmospheric pressure collisions occur on a very short time scale, the ionization cascade causes all of the available charge to reside on the most basic molecules. Because of the abundance of water vapor or even more basic substances such as solvent and contaminants, in APCI, only compounds more basic than, for example, the protonated water clusters become ionized.

This cascading effect can be used to advantage by adding a reactive gas (flow arrow 66) from a gas source 66G (see FIG. 2). Ammonia gas is useful as the reactive gas so that only compounds that can either attach $NH_4^+$ ions or are more basic than $[(NH_3)_n)]H^+$ will be ionized. Alternatively, the use of a dry clean purge gas (flow arrow 64), such as nitrogen gas obtained from vaporization of liquid nitrogen (previously described), can be used to reduce the amount of water and other basic contaminant gases in the ionization region 19 so that higher energy species are available for ionization. Under these conditions compounds such as methylcyclohexanone, naphthalene, dimethylphenol, dinitrobenzene, and chloromethylphenol, which do not ionize or ionize poorly under positive ion LC/API conditions, will ionize readily under GC elution with the inert purge gas.

As shown in FIG. 3, ionization may also be generated using a UV lamp with photo-energy output between about eight and twelve electron volts (eV). In photoionization, ionization occurs by stripping an electron from those molecules in which the ionization potential is below the eV output of the UV lamp source. Photoionization light sources are described in a number of patents, for example U.S. Pat. No. 5,338,931, U.S. Pat. No. 5,808,299, U.S. Pat. No. 5,393,979, U.S. Pat. No. 5,338,931, and U.S. Pat. No. 5,206,594. Even though the molecules of interest are ionized directly, they can lose charge by ion-molecule reactions, as described above, to water and other contaminants in the ionization region.

In FIG. 3 a photoionization lamp 68 is mounted on the enclosure 11 and has a connector V for application of a voltage to power the lamp. Also shown is an electrode 70 connected to a source of high voltage HV that operates in a voltage range between zero to five hundred volts to help focus ions on the aperture 54 to the mass spectrometer.

Alternatively, ionization can be produced from an ESI capillary or wick as described in U.S. Pat. No. 6,297,499. Sensitivity may be enhanced by use of lower flow rates of liquid through the capillary or by use of small diameter wicks. Therefore, nanospray, as described in U.S. Pat. No. 5,788,166 (Valaskovic, et al.) appears to produce the most sensitive results using this method of ionization. A commercially available nanospray needle, that can operate for many hours with just a few microliters of solvent, is a simple solution for production of primary ions. By using the nanospray needle in the typical manner used for nano-electrospray, but using a pure solvent such as methanol, water, acetonitrile or mixtures thereof, the gas phase analyte molecules from a GC or other source become entrained in the liquid droplets and are ionized by the electrospray process described above. This ionization mode is more selective as to the types of compounds that can be ionized and generally produces only quasi-molecular ions with little or no fragmentation. The advantage of this ionization process is that typically only $[M+H]^+$ ions are produced in the positive ion mode from polar compounds that are sufficiently basic to accept a proton from the liquid media used to produce the primary ionization, assuming no thermal fragmentation. The ionization can be influenced by addition of an additive to either the solvent being used in the nanospray process or into the gas phase. For example, addition of $NH_3$ gas into the ionization region will cause only molecules more basic than ammonia gas to be ionized by protonation, but cationization by $NH_4^+$ addition will occur with a wider variety of compounds. This allows the ionization process to be tailored to the analytical problem.

With some of these ionization methods, little fragmentation is obtained. However, when fragmentation is needed for structural elucidation it can be generated in the region on vacuum side 53 of the entrance aperture 54 (FIGS. 1-3) of atmospheric pressure ion sources by application of a voltage that increases the collision energy of ions in this intermediate pressure region. Alternatively, so called MS/MS or MS″ mass spectrometers can be used to select an ion of a specific mass using one mass analyzer for fragmentation by gas or surface collisions and then using a second mass analyzer to obtain a mass spectrum of the fragment ions. Combining MS/MS and selected ion, or multiple ion, monitoring with the high chromatographic resolution of GC/APIMS is a powerful and highly selective tool for the analysis of trace volatile components in complex mixtures. Because a large number of mass spectrometers that are designed for LC/MS operation are capable of high accuracy mass measurement of ions, using the arrangement of the present invention these instruments can now be used to accurately measure the mass of ions produced in the gas phase, such as from a gas chromatograph.

Thus, the method described to produce ions, either positive or negative, from gaseous compounds at atmospheric pressure with analysis by mass spectrometry has a number of advantages over current instrumentation. For example, a gas chromatograph can be interfaced to a commercially available LC/MS instrument. Because ionization is at atmospheric pressure, gas flow through the GC column is not limited by the ionization source as it is with GC/MS using vacuum ionization. Low boiling compounds can be made to pass through a GC column by using a thin stationary phase, a shorter column and higher gas flow through the column. Therefore, GC/APIMS provides for compound separation from a mixture of compounds with subsequent ionization of volatile and semi-volatile components. Compounds ionized with these methods will have all of the analytical benefits of the mass spectrometer being employed as to generation of fragmentation and making accurate mass measurements.

Reduction of contaminants generated by heating the polyimide coated GC column can be accomplished by flame removal of the coating over the area of the column that comes in direct contact with the external inert gas flow or by conditioning at high temperature in the interface probe for several hours.

Figure 5A:
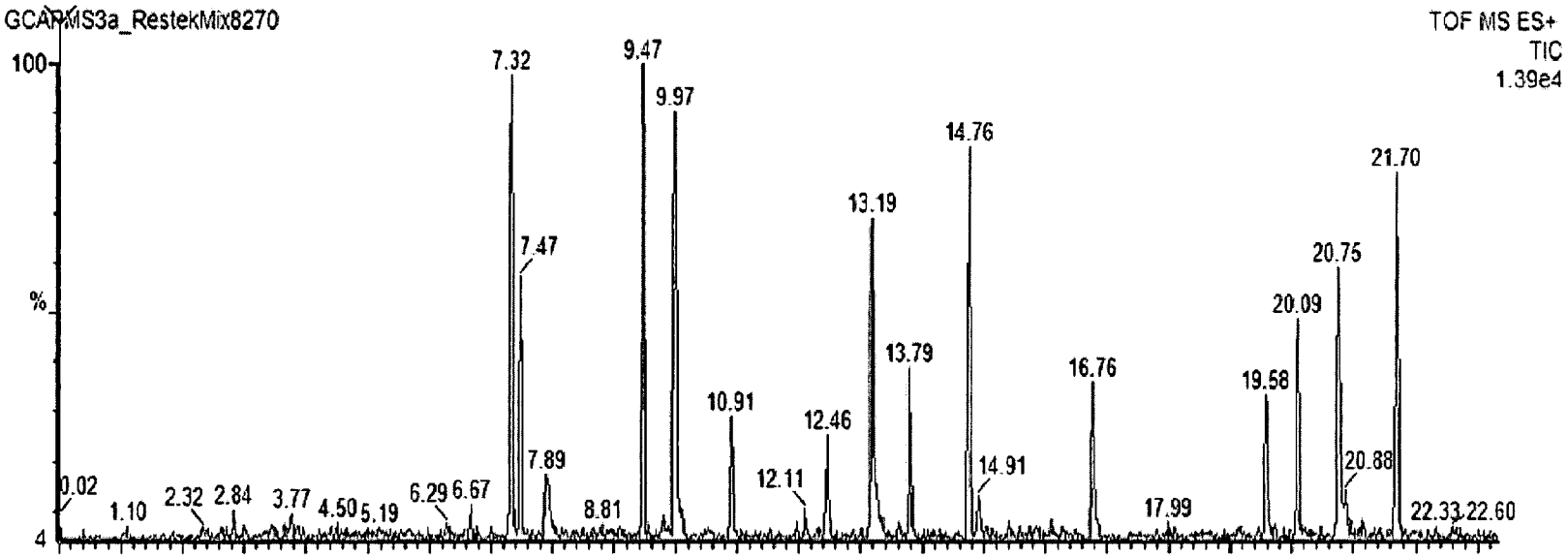
FIGS. 5A-5C are chromatograms of a commercial calibration mixture separated by GC and ionized by atmospheric pressure chemical ionization (APCI) where time is plotted along the X-axis and the total ion current registered by the mass spectrometer is plotted along the Y-axis.
Figure 5B:
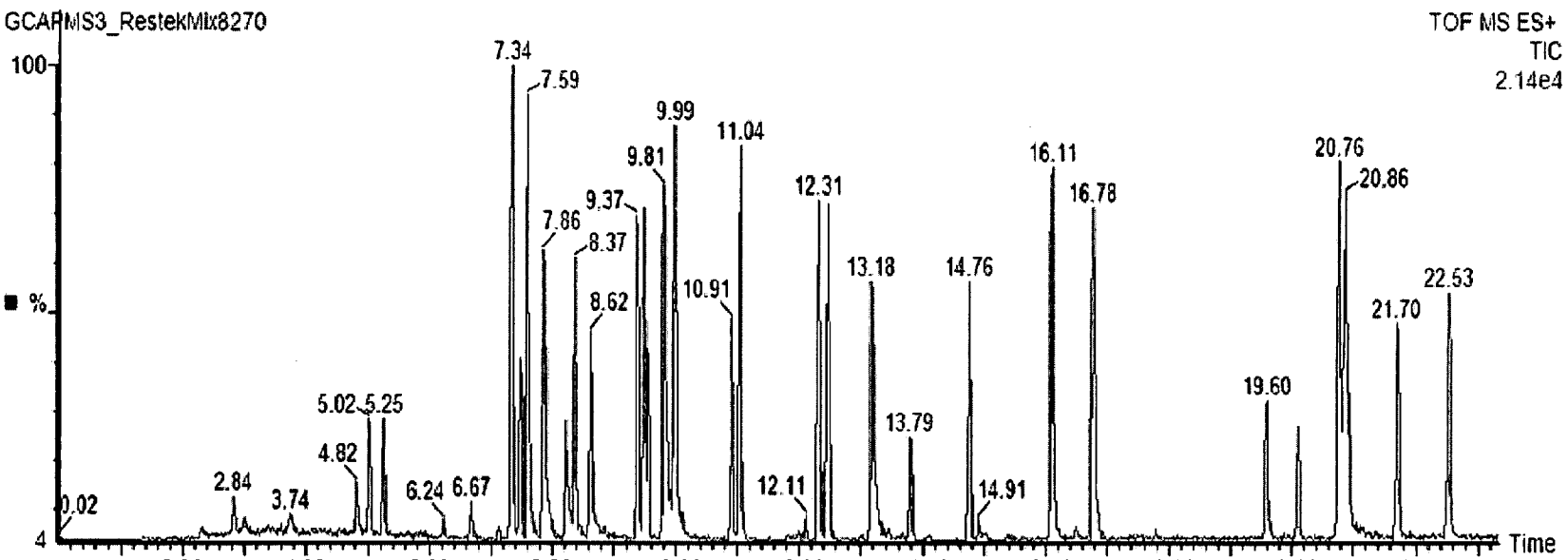
Figure 5C:
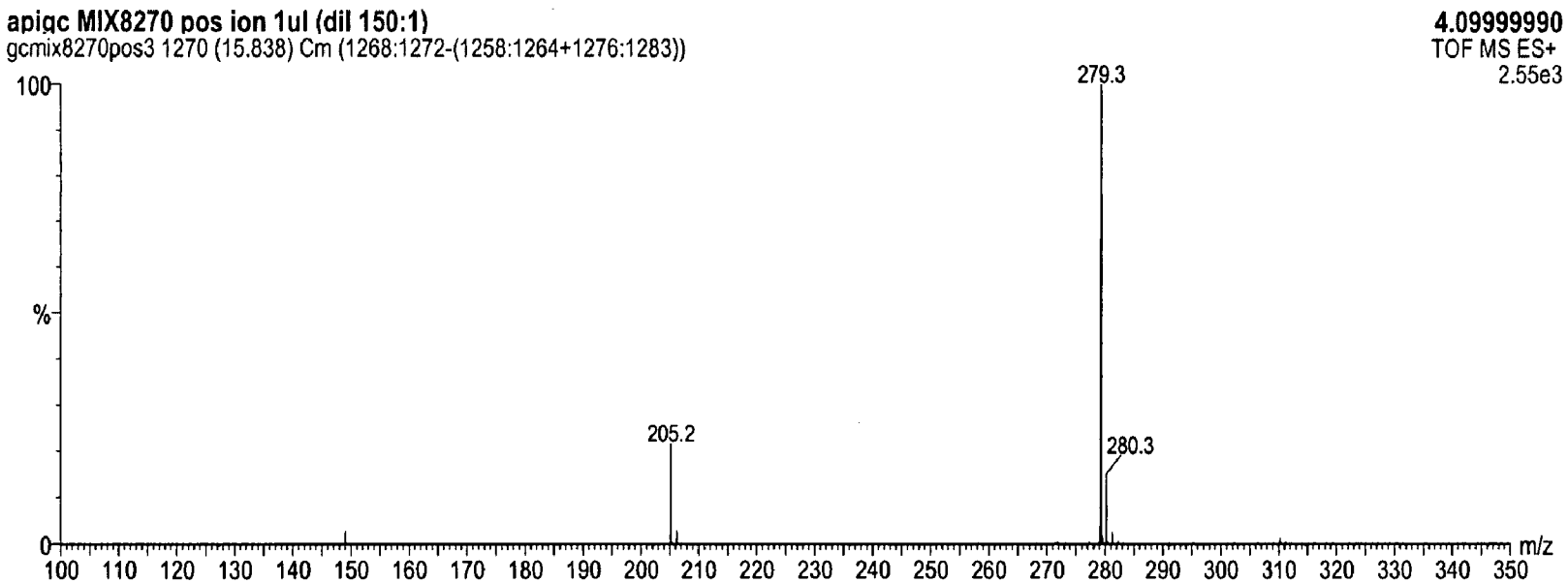

It has been discovered that ionization can be altered by the addition of gases to the ionization region. In particular, bathing the ionization region with dry clean inert gas such as nitrogen (hereafter called a purge gas) increases the types of compounds amenable to this method. FIGS. 5A, 5B and 5C are chromatograms of a commercial calibration mixture separated by GC and ionized by APCI where time is plotted along the X-axis and the total ion current registered by the mass spectrometer is plotted along the Y-axis. FIG. 5A shows a resulting chromatogram with no purge gas. FIG. 5B shows a resulting chromatogram using nitrogen as a purge gas. FIG. 5C shows the API mass spectrum of a compound in the calibration mixture eluting from the GC.

It is also known that reactive gases, such as ammonia in the positive ion mode or methylene chloride in the negative ion mode, can be used to alter the ionization process. The addition of ammonia gas increases the specificity of the ionization. Either positive or negative ions can be used for the analysis of compounds eluting from the gas chromatograph or liquid chromatograph. In the case of negative ionization, methylene chloride is an additive gas that can be used to enhance the ionization process for certain compound types. The sensitivity of this method is comparable to that of currently available ionization methods used with gas chromatography or liquid chromatography and frequently superior.

Those skilled in the art, having the benefit of the teachings of the present invention as hereinabove set forth may effect modifications thereto. Such modifications are to be construed as lying within the contemplation of the present invention, as defined by the appended claims.

What is claimed is:

1. An ionization source useful with an atmospheric pressure mass spectrometer comprising:

a source capable of ionizing either liquid or gaseous effluent from a preceding separation apparatus and of introducing the ions from an atmospheric pressure region of the mass spectrometer into a vacuum region of the mass spectrometer for mass analysis of the ions, the source including:

an ionization arrangement, an enclosure for enclosing the ionization arrangement thereby defining an ionization region, the enclosure having at least one port for introducing an effluent, and an aperture for introducing ions into the vacuum region of the mass spectrometer, wherein the at least one port for introducing an effluent is configured to accept an interface from either a source of liquid effluent or a source of gaseous effluent, the enclosure further comprising a port for introducing a purge gas and a vent for venting excess purge gas from the enclosure, and a port for introducing a reactive gas and a vent for venting excess reactive gas from the enclosure, and an interface for facilitating the transport of chemical components from either a source of liquid effluent or a source of gaseous effluent into the atmospheric pressure region, the interface comprising a tubular member, made of a high temperature tolerant material, having an exit end and an entrance end, the interior of the tubular member being able to be heated to produce a uniform temperature throughout the interior of the tubular member.

2. The ionization source of claim 1, wherein the ionization arrangement produces ions by generating an electric discharge, the ionization arrangement being connected to a high voltage source.

3. The ionization source of claim 2, wherein the ionization arrangement for generating an electric discharge comprises a sharp-edged or pointed electrode onto which a high voltage is applied to generate a Townsend or corona discharge.

4. The ionization source of claim 3, wherein the electrode is a needle.

5. The ionization source of claim 3, wherein the electrode is a capillary tube.

6. The ionization source of claim 3, wherein the high voltage is between one thousand and ten thousand volts.

7. The ionization source of claim 2, wherein the ionization arrangement for generating an electric discharge comprises a solvent-filled capillary or wick structure whereby an electrospray ionization is generated by application of a high voltage.

8. The ionization source of claim 7, wherein the high voltage is between two thousand and six thousand volts.

9. The ionization source of claim 1, wherein the ionization arrangement produces ions by the interaction of photons from a ultraviolet source with gas phase molecules.

10. The ionization source of claim 9, wherein the ionization arrangement for generating UV radiation comprises a UV lamp.

11. The ionization source of claim 1, wherein the port for introducing the purge gas also comprises a heater for heating the gas.

12. The ionization source of claim 1, wherein the at least one port for introducing an effluent is configured as multiple ports, each port being configured to accept an interface probe from a respective preceding separation apparatus.

13. The ionization source of claim 12, where each preceding separation apparatus supplies a liquid effluent or gaseous effluent.

14. The ionization source of claim 1, wherein the interface is disposed between a gas chromatograph having a heated oven and the atmospheric pressure mass spectrometer ion source, the interface facilitating the transport of chemical components from the gas chromatograph into the atmospheric pressure ionization region, the exit end of the interface connecting the heated oven of the gas chromatograph to a volume in the ionization region that is adjacent to the mass spectrometer ion entrance aperture, the tubular member configured to receive a capillary gas chromatographic column in a coaxial manner, wherein the interior of the tubular member is able to be resistively heated, thereby heating the gas chromatographic column uniformly over its entire length.

15. The ionization source of claim 14, further comprising a sheath tube coaxially surrounding the capillary gas chromatographic column, the sheath tube having an exit end substantially flush with an exit end of the capillary, the sheath tube receiving an inert gas from a gas source, the inert gas being heated by the oven of the gas chromatograph and by the resistively heated tubular member of the interface, so that the capillary column temperature is substantially uniform all the way to its exit end and the effluent flowing from the exit end of the capillary is surrounded by the heated inert gas as the effluent enters the ionization region.

16. The ionization source of claim 15, further comprising the exit end of the sheath tube being shaped to focus the flow of effluent into the ionization region, thereby increasing the sensitivity of the mass spectrometer to the ions produced, the gas flow removing un-ionized effluent molecules from the ionization region to maintain chromatographic resolution.

17. The ionization source of claim 15, further comprising the region of the capillary gas chromatographic column adjacent to its exit end being pre-conditioned by chemical treatment to remove any organic coating from the surface of the capillary thus minimizing the introduction of organic thermal degradation contaminants into the ionization region by the gas flowing through the sheath tube.

18. The ionization source of claim 15, further comprising the region of the capillary gas chromatographic column adjacent to its exit end being pre-conditioned by heating said region to a temperature for a time period sufficient to remove volatile contaminants from the volume swept by the inert gas passing through the sheath tube.

19. The ionization source of claim 1, wherein the tubular member of the interface is electrically conductive.

20. The ionization source of claim 1, wherein the tubular member of the interface is electrically non-conductive.

21. The ionization source of claim 1, wherein the tubular member of the interface has a length between 1 centimeter and 2 meters.

22. The ionization source of claim 1, wherein the exit end of the tubular member of the interface is positioned within 5 centimeters of the mass spectrometer ion entrance aperture.

23. The ionization source of claim 1, wherein the exit end of the tubular member of the interface is positioned within 1 centimeter of the mass spectrometer ion entrance aperture.

24. The ionization source of claim 1, the interface further comprising a miniaturized gas chromatograph comprising an injector, an oven and a gas chromatographic capillary column, the injector, the oven, and the chromatographic capillary column all being heated in a controlled manner.

25. The ionization source of claim 24, wherein the interface is interchangeable with a liquid introduction probe.

26. A chromatographic method comprising the steps of:

(a) using an atmospheric pressure ionization source having an ionization arrangement, and an enclosure for enclosing the ionization arrangement, the enclosure defining an ionization region, the enclosure having at least one port for introducing an effluent, an outlet aperture, a port for introducing a purge gas, and a vent for venting excess purge gas from the enclosure, the enclosure also having an interface for facilitating the transport of chemical components into the atmospheric pressure ionization source, the interface comprising a tubular member, made of a high temperature tolerant material, having an exit end and an entrance end, the interior of the tubular member being able to be heated to produce a uniform temperature throughout the interior of the tubular member, ionizing either a liquid or a gaseous effluent from a preceding separation apparatus and introducing the ions through the outlet aperture into a vacuum region of a mass spectrometer for mass analysis of the ions; and (b) maintaining a flow of inert purge gas through the ionization region to rapidly remove compounds that are not ionized in the time scale of the chromatographic resolution, thereby improving the chromatographic resolution in a mass spectrometer ion signal from a gas effluent.

27. A chromatographic method comprising the steps of:

(a) using an atmospheric pressure ionization source having an ionization arrangement, and an enclosure for enclosing the ionization arrangement, the enclosure defining an ionization region, the enclosure having at least one port for introducing an effluent, an outlet aperture, a port for introducing a purge gas, and a vent for venting excess purge gas from the enclosure the enclosure also having an interface for facilitating the transport of chemical components into the atmospheric pressure ionization source, the interface comprising a tubular member, made of a high temperature tolerant material, having an exit end and an entrance end, the interior of the tubular member being able to be heated to produce a uniform temperature throughout the interior of the tubular member, ionizing either a liquid or a gaseous effluent from a preceding separation apparatus and introducing the ions through the outlet aperture into a vacuum region of the mass spectrometer for mass analysis of the ions; and (b) maintaining a flow of dry clean purge gas through the ionization region to rapidly remove compounds that are not ionized in the time scale of the chromatographic resolution, thereby increasing the number of classes of chemical compounds that can be ionized in the effluent by minimizing low energy ionization events by reducing water and other impurities in the ionization region.

28. A chromatographic method comprising the steps of:

(a) using an atmospheric pressure ionization source having an ionization arrangement, and an enclosure for enclosing the ionization arrangement, the enclosure defining an ionization region, the enclosure having at least one port for introducing an effluent, an outlet aperture, a port for introducing a purge gas, and a vent for venting excess purge gas from the enclosure the enclosure also having an interface for facilitating the transport of chemical components into the atmospheric pressure ionization source, the interface comprising a tubular member, made of a high temperature tolerant material, having an exit end and an entrance end, the interior of the tubular member being able to be heated to produce a uniform temperature throughout the interior of the tubular member, ionizing a gaseous effluent from a preceding separation apparatus, and introducing the ions through the outlet aperture into a vacuum region of a mass spectrometer for mass analysis of the ions, wherein the separation apparatus is a gas chromatographic capillary column that is sufficiently small so that the gas chromatographic injector, oven, and interface, are all heated in a controlled manner; and (b) maintaining a flow of dry clean purge gas through the ionization region to rapidly remove compounds that are not ionized in the time scale of the chromatographic resolution, thereby increasing the number of classes of chemical compounds that can be ionized in the effluent of a gas chromatograph by minimizing low energy ionization events by reducing water and other impurities in the ionization region.

29. A chromatographic method comprising the steps of:

(a) using an atmospheric pressure ionization source having an ionization arrangement, and an enclosure for enclosing the ionization arrangement, the enclosure defining an ionization region, the enclosure having at least one port for introducing an effluent, an outlet aperture, a port for introducing a purge gas, and a vent for venting excess purge gas from the enclosure the enclosure also having an interface for facilitating the transport of chemical components into the atmospheric pressure ionization source, the interface comprising a tubular member, made of a high temperature tolerant material, having an exit end and an entrance end, the interior of the tubular member being able to be heated to produce a uniform temperature throughout the interior of the tubular member, ionizing compounds of interest in either a liquid or a gaseous effluent from a preceding separation apparatus and introducing the ions through the outlet aperture into a vacuum region of a mass spectrometer for mass analysis of the ions; and (b) maintaining a flow of reactive gas through the ionization region to rapidly remove compounds that are not ionized in the time scale of the chromatographic resolution, thereby enhancing analysis of a selected class of chemical compounds.

* * * * *

UNITED STATES PATENT AND TRADEMARK OFFICE

CERTIFICATE OF CORRECTION

PATENT NO. : 7,642,510 B2
APPLICATION NO. : 11/508444
DATED : January 5, 2010
INVENTOR(S) : Charles Nehemiah McEwen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 548 days.

Signed and Sealed this

Sixteenth Day of November, 2010

David J. Kappos

David J. Kappos
*Director of the United States Patent and Trademark Office*